US010081094B2

(12) United States Patent
Doroslovac et al.

(10) Patent No.: US 10,081,094 B2
(45) Date of Patent: Sep. 25, 2018

(54) MULTI-GRIP SOCKET BIT

(71) Applicant: Grip Tooling Technologies LLC, Brandon, FL (US)

(72) Inventors: Robert S Doroslovac, Massilon, OH (US); Paul Kukucka, Brandon, FL (US); Thomas Stefan Kukucka, Brandon, FL (US)

(73) Assignee: GRIP TOOLING TECHNOLOGIES LLC, Brandon, FL (US)

( * ) Notice: Subject to any disclaimer, the term of this patent is extended or adjusted under 35 U.S.C. 154(b) by 0 days.

(21) Appl. No.: 15/650,768

(22) Filed: Jul. 14, 2017

(65) Prior Publication Data

US 2017/0312897 A1 Nov. 2, 2017

Related U.S. Application Data

(63) Continuation-in-part of application No. 29/566,336, filed on May 27, 2016, now Pat. No. Des. 794,405,
(Continued)

(51) Int. Cl.
*B25B 23/10* (2006.01)
*B25B 23/00* (2006.01)
(Continued)

(52) U.S. Cl.
CPC ..... *B25B 23/105* (2013.01); *B25B 15/001* (2013.01); *B25B 15/004* (2013.01);
(Continued)

(58) Field of Classification Search
CPC ..... B25B 27/18; B25B 13/065; B25B 15/001; B25B 15/004; B25B 13/485; F16B 23/003; F16B 23/0061; F16B 23/0076
(Continued)

(56) References Cited

U.S. PATENT DOCUMENTS 6,761,089 B2 * 7/2004 Bergamo ..... B25B 27/18 81/441
7,000,501 B1 * 2/2006 Chen ..... B25B 27/18 7/158
(Continued)

FOREIGN PATENT DOCUMENTS

AU 201612229 4/2016
AU 201612720 6/2016
(Continued)

*Primary Examiner* — Joseph J Hail
*Assistant Examiner* — Brian D Keller

(57) ABSTRACT

A screw bit body which allows for efficient torque force application onto a socket fastener. The screw bit body includes a plurality of laterally-bracing sidewalls, a first base, and a second base. The laterally-bracing sidewalls are radially distributed about a rotation axis of the screw bit body with each further including a first lateral edge, a second lateral edge, a bracing surface, and an engagement cavity. The engagement cavity creates an additional gripping point to prevent slippage in between the screw bit body and the socket fastener. The engagement cavity traverses normal and into the bracing surface. Additionally, the engagement cavity traverses into the screw bit body from the first base to the second base. The engagement cavity is specifically positioned offset from the first lateral edge by a first distance and positioned offset from the second lateral edge by a second distance.

8 Claims, 7 Drawing Sheets

Related U.S. Application Data and a continuation-in-part of application No. 29/566,311, filed on May 27, 2016, now Pat. No. Des. 798,682, and a continuation-in-part of application No. 14/701,482, filed on Apr. 30, 2015, application No. 15/650,768, filed on Jul. 14, 2017, which is a continuation-in-part of application No. 15/278,845, filed on Sep. 28, 2016, now Pat. No. 9,687,968, application No. 15/650,768, filed on Jul. 14, 2017, which is a continuation-in-part of application No. 15/601,864, filed on May 22, 2017, and a continuation-in-part of application No. PCT/IB2017/052453, filed on Apr. 27, 2017, application No. 15/650,768, filed on Jul. 14, 2017, which is a continuation-in-part of application No. 29/592,608, filed on Jan. 31, 2017, now abandoned, and a continuation-in-part of application No. 29/604,799, filed on May 19, 2017.

(60) Provisional application No. 61/986,327, filed on Apr. 30, 2014, provisional application No. 62/328,102, filed on Apr. 27, 2016, provisional application No. 62/475,757, filed on Mar. 23, 2017, provisional application No. 62/451,491, filed on Jan. 27, 2017, provisional application No. 62/459,371, filed on Feb. 15, 2017, provisional application No. 62/482,916, filed on Apr. 7, 2017, provisional application No. 62/531,828, filed on Jul. 12, 2017.

(51) Int. Cl.
*B25B 15/00* (2006.01)
*B25B 21/00* (2006.01)

(52) U.S. Cl.
CPC ..... *B25B 15/008* (2013.01); *B25B 23/0035* (2013.01); *B25B 23/108* (2013.01); *B25B 21/00* (2013.01)

(58) Field of Classification Search
USPC ..... 81/53.2, 436, 460; 411/403–404
See application file for complete search history.

(56) References Cited

U.S. PATENT DOCUMENTS

| | | | | |
|---|---|---|---|---|
| 7,225,710 | B2 * | 6/2007 | Pacheco, Jr. | B25B 13/065 411/403 |
| 7,331,260 | B2 * | 2/2008 | Cheng | B25B 13/04 81/119 |
| D776,505 | S | 1/2017 | Doroslovac | |
| D784,106 | S | 4/2017 | Doroslovac | |
| 2011/0271800 | A1 * | 11/2011 | Lin | B25B 15/008 81/436 |
| 2015/0314429 | A1 | 11/2015 | Doroslovac | |

FOREIGN PATENT DOCUMENTS

| | | |
|---|---|---|
| AU | 201612721 | 6/2016 |
| CA | 168071 | 12/2016 |
| CN | 303924849 | 11/2016 |
| CN | 303956827 | 12/2016 |
| CN | 303984883 | 12/2016 |
| CN | D180038 | 12/2016 |
| DM | 090809 | 4/2016 |
| DM | 091188 | 5/2016 |
| DM | 091189 | 5/2016 |

* cited by examiner

MULTI-GRIP SOCKET BIT

FIELD OF THE INVENTION

The present invention generally relates to various tools designed for tightening or loosening fasteners, in particular bolts and nuts. More specifically, the present invention is an anti-slip multidirectional driver bit, designed to prevent damaging or stripping fasteners during the extraction or tightening process.

BACKGROUND OF THE INVENTION

Hex bolts, nuts, screws, and other similar threaded devices are used to secure and hold multiple components together by being engaged to a complimentary thread, known as a female thread. The general structure of these types of fasteners is a cylindrical shaft with an external thread and a head at one end of the shaft. The external thread engages a complimentary female thread tapped into a hole or a nut and secures the fastener in place, fastening the associated components together. The head receives an external torque force and is the means by which the fastener is turned, or driven, into the female threading. The head is shaped specifically to allow an external tool like a wrench to apply a torque to the fastener in order to rotate the fastener and engage the complimentary female threading to a certain degree. This type of fastener is simple, extremely effective, cheap, and highly popular in modern construction.

One of the most common problems in using these types of fasteners, whether male or female, is the tool slipping in the head portion, or slipping on the head portion. This is generally caused by either a worn fastener or tool, corrosion, overtightening, or damage to the head portion of the fastener. The present invention is a driving bit design that virtually eliminates slippage. The design uses a series of segmented portions that bite into the head of the fastener and allow for efficient torque transfer between the driving bit and the head portion of the fastener. The present invention eliminates the need for the common bolt extractors as they require unnecessary drilling and tools. With the development of electric screwdrivers, and drills, people have been using, power tools to apply the required torsional forces and remove various fasteners. The present invention provides a double-sided driver end bit, thus allowing for torque to applied to the fastener in both clockwise and counterclockwise directions, thus tightening or loosening the fastener. Most driver end bits have a standardized one fourth inch hex holder, and come in various configurations including but not limited to, square end, hex end, or star end.

DETAIL DESCRIPTIONS OF THE INVENTION

All illustrations of the drawings are for the purpose of describing selected versions of the present invention and are not intended to limit the scope of the present invention.

The present invention generally related to torque tool accessories. More specifically, the present invention is a multi-grip socket bit, also known as a screw bit or driver. The present invention allows for a higher torque to be applied to a fastener than a similarly sized conventional driver bit without damaging the head of the fastener or the bit tool. This is achieved through the use of a multitude of engagement features which effectively grip the head of the fastener. The present invention is a socket bit that is compatible with a variety of torque tools including, but not limited to, traditional drills, bit-receiving screwdrivers, socket wrenches, and socket drivers.

Figure 1:
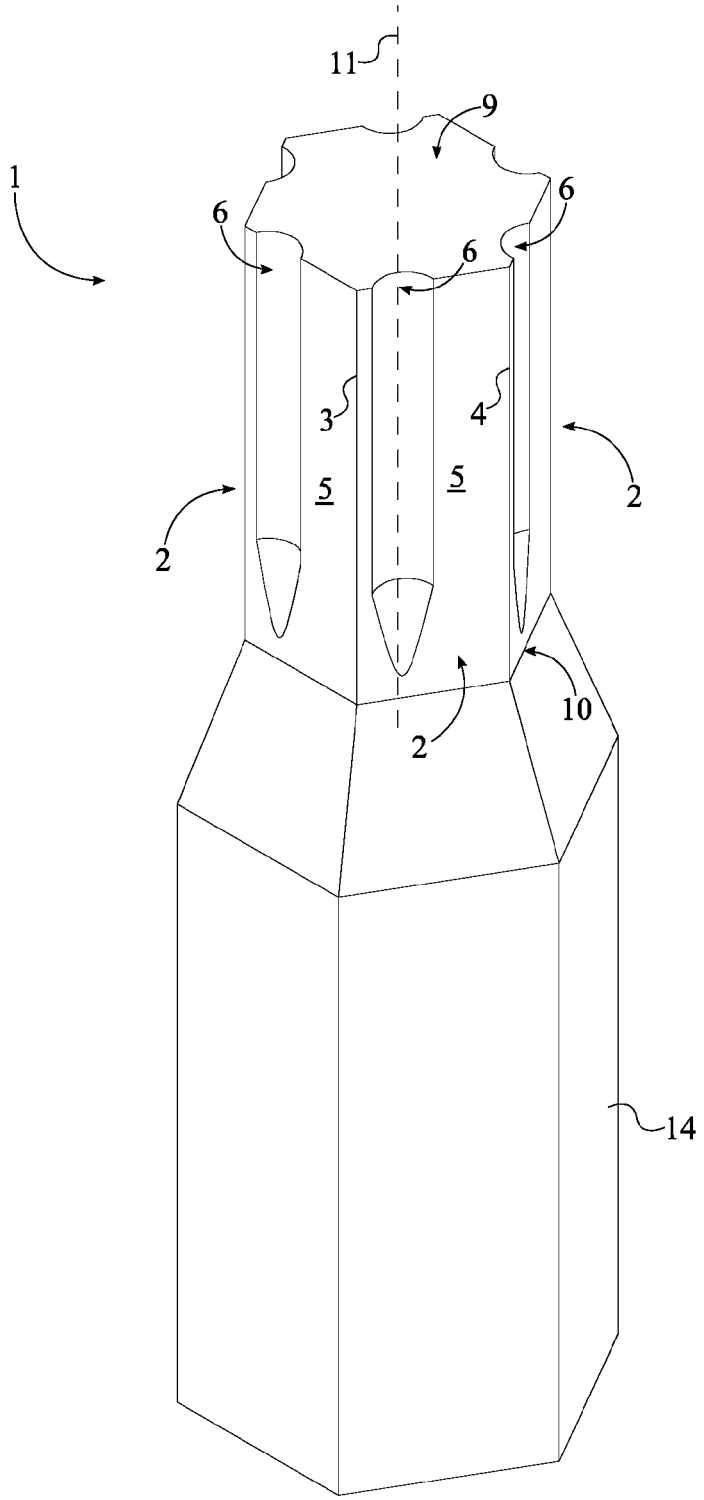
FIG. 1 is a perspective view of the present invention.

In its simplest embodiment, referring to FIG. 1, the present invention comprises an at least one screw bit body 1. The screw bit body 1 is a shank which engages the socket fastener, such as a socket screw or a socket bolt, in order to apply a torque force onto the socket faster. The screw bit body 1 comprises a plurality of laterally-bracing sidewalls 2, a first base 9, and a second base 10. In general, the screw bit body 1 is a prism composed of a strong metal. Each of the plurality of laterally-bracing sidewalls 2 engage within and grip the socket fastener in order to efficiently transfer torque from a torque tool to the socket fastener. The first base 9 and the second base 10 are positioned opposite to each other along the plurality of laterally-bracing sidewalls 2. Additionally, the first base 9 and the second base 10 are oriented perpendicular to each of the laterally-bracing sidewalls and thus enclose/complete the prism shape of the screw bit body 1.

Figure 3:
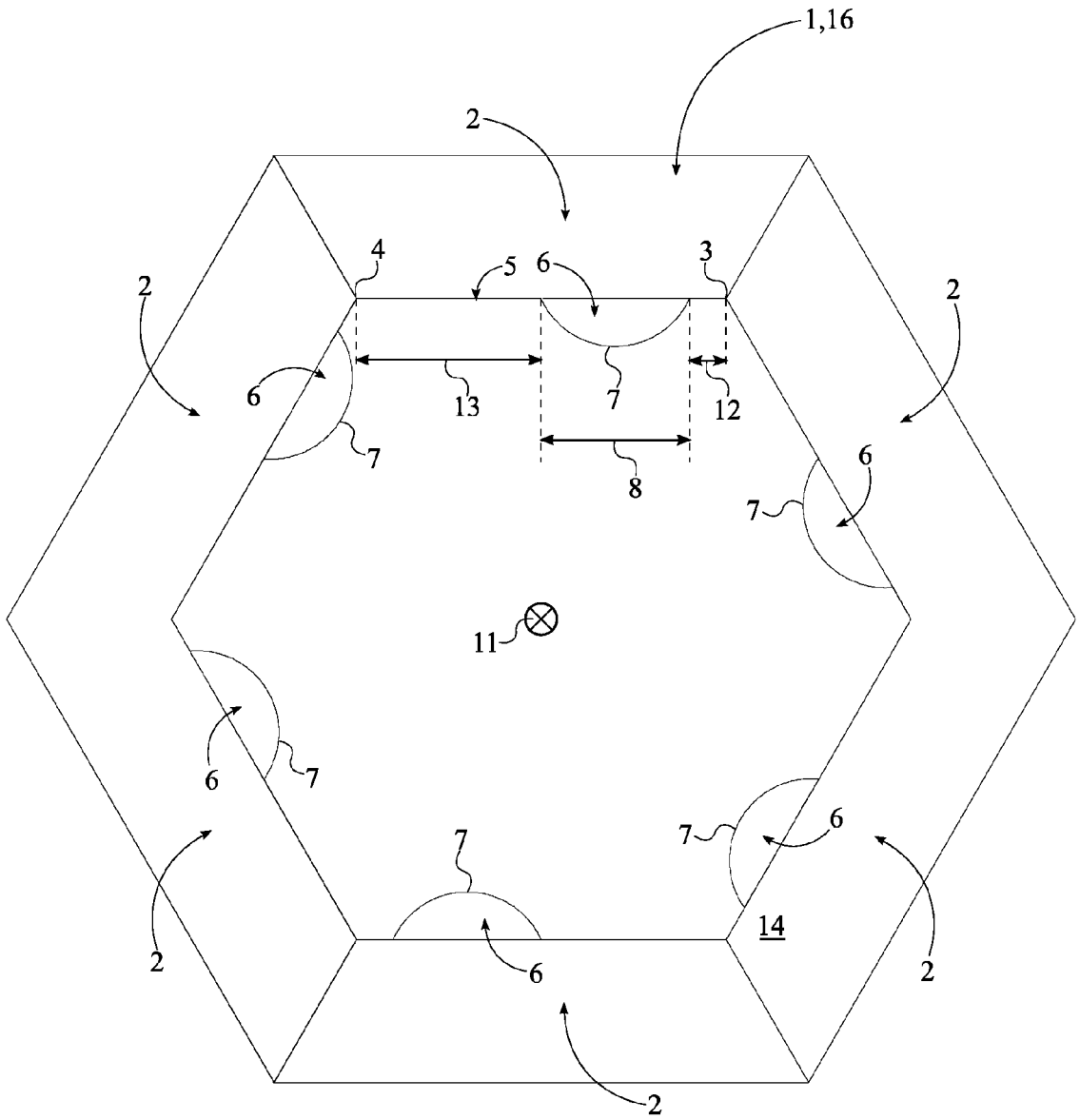
FIG. 3 is a top view of the alternative embodiment of the present invention.
Figure 4:
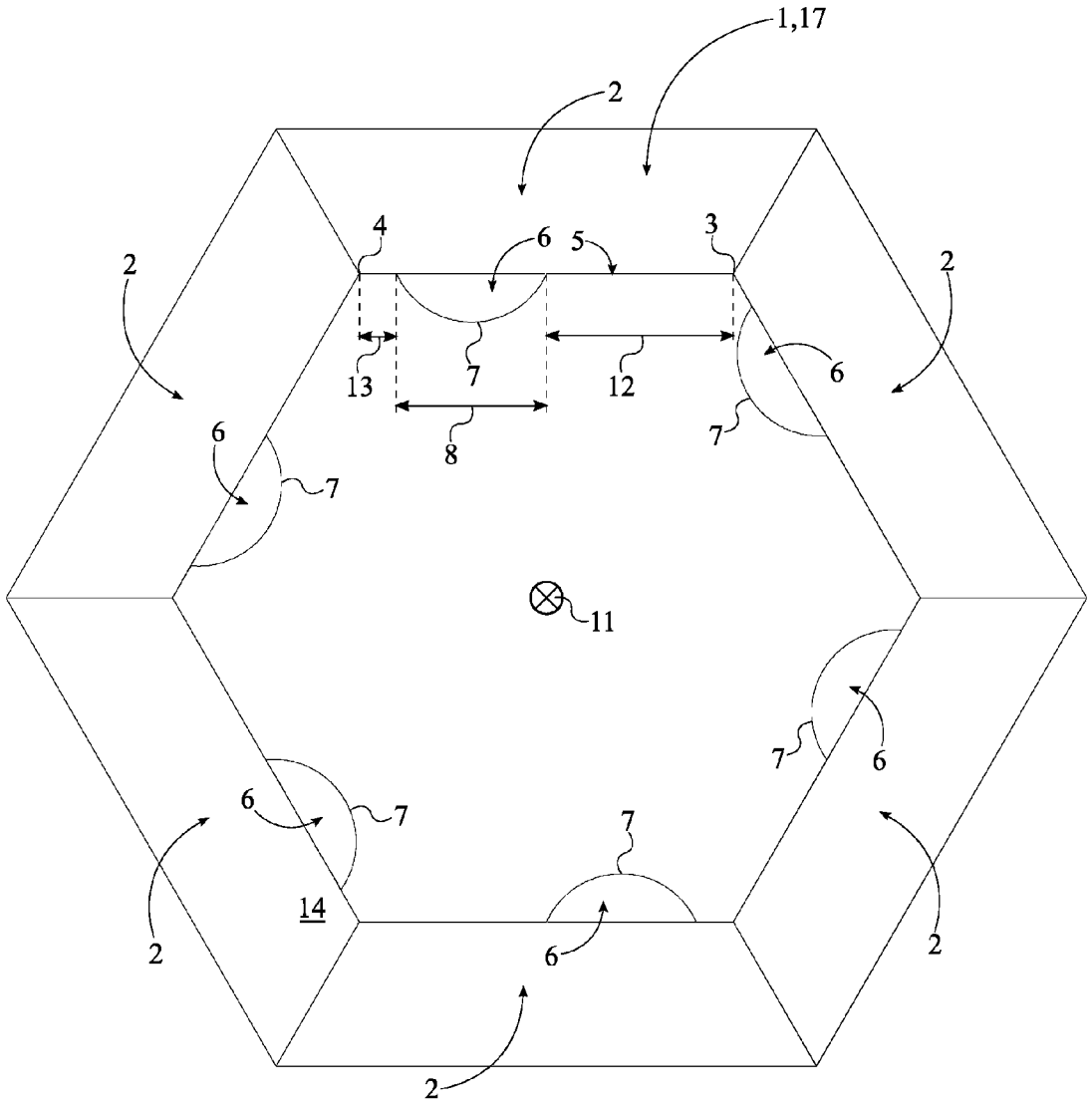
FIG. 4 is a bottom view of the alternative embodiment of the present invention.

Referring to FIG. 3 and FIG. 4, each of the laterally-bracing sidewalls comprises a first lateral edge 3, a second lateral edge 4, a bracing surface 5, and an at least one engagement cavity 6. The plurality of laterally-bracing sidewalls 2 is radially positioned about a rotation axis 11 of the screw bit body 1 in order to yield a geometric profile complimentary to that of the socket fastener. The number within the plurality of laterally-bracing sidewalls 2 is subject to change to compliment the shape and profile of a variety of socket fasteners. In one embodiment of the present invention, the number within the plurality of laterally-bracing sidewalls 2 is six and the resulting geometric profile of the screw bit body 1 is a hexagon. In an alternative embodiment of the present invention, the number within the plurality of laterally-bracing sidewall is four and the resulting geometric profile of the screw bit body 1 is a square.

The bracing surface 5 physically presses against the socket fastener, in particular the lateral sidewall of a head portion from the socket fastener. The first lateral edge 3 and the second lateral edge 4 are positioned opposite to each other across the bracing surface 5. When viewed from either the top perspective or the bottom perspective, the first lateral edge 3 and the second lateral edge 4 from each of the plurality of laterally-bracing sidewalls 2 make up the corners of the screw bit body 1. The engagement cavity 6 traverses normal and into the bracing surface 5 and creates an additional gripping point/tooth on the bracing surface 5. This gripping point is created with the engagement cavity 6 and an adjacent edge, wherein the adjacent edge is either the first lateral edge 3 or the second lateral edge 4; in particular, the adjacent edge is the edge closest to the engagement cavity 6. Additionally, the engagement cavity 6 traverses into the screw bit body 1 from the first base 9 towards the second base 10. The engagement cavity 6 also tapers from the first base 9 to the second base 10. This ensures that the additional gripping point extends along the length of the screw bit body 1 for maximum grip engagement between the screw bit body 1 and the socket fastener. Furthermore, it is preferred that a cross-section 7 of the engagement cavity 6 is a semi-circular profile. The semi-circular profile ensures that there are little to no high stress points in the screw bit body 1, thus increasing the overall longevity of the tool. Alternative profiles may be used for the engagement cavity 6 including, but not limited to, a semi-square profile, a semi-rectangular profile, and a semi-oval profile.

In the preferred embodiment of the present invention, the engagement cavity 6 is positioned specifically for the most efficient transfer of torque. In particular, the engagement cavity 6 is positioned offset from the first lateral edge 3 by a first distance 12. Similarly, the engagement cavity 6 is positioned offset from the second lateral edge 4 by a second distance 13. The proportion between the first distance 12, the second distance 13, and a width 8 of the engagement cavity 6 is 1:5:4 for the most efficient transfer of torque.

The proportion between the first distance 12, the second distance 13, and the width 8 of the engagement cavity 6 may be switched and altered in order to achieve a clockwise and counterclockwise design. Referring to FIG. 1, the present invention is configured to be a clockwise drive bit. For this embodiment, the first distance 12 is less than the second distance 13. In particular, the proportion between the first distance 12, the second distance 13, and the width 8 of the engagement cavity 6 is 1:5:4, thus yielding a design of the present invention which grips and applies torque to the socket fastener in the clockwise direction. This design is used to screw in and secure the socket fastener. In another embodiment, the present invention is configured to be a counter-clockwise screw bit. For this embodiment, the first distance 12 greater than the second distance 13. In particular, the proportion between the first distance 12, the second distance 13, and the width 8 of the engagement cavity 6 is 5:1:4, thus yielding a design which grips and applies torque to the socket fastener in the counter-clockwise direction. This design is used to release and extract the socket fastener.

Figure 5:
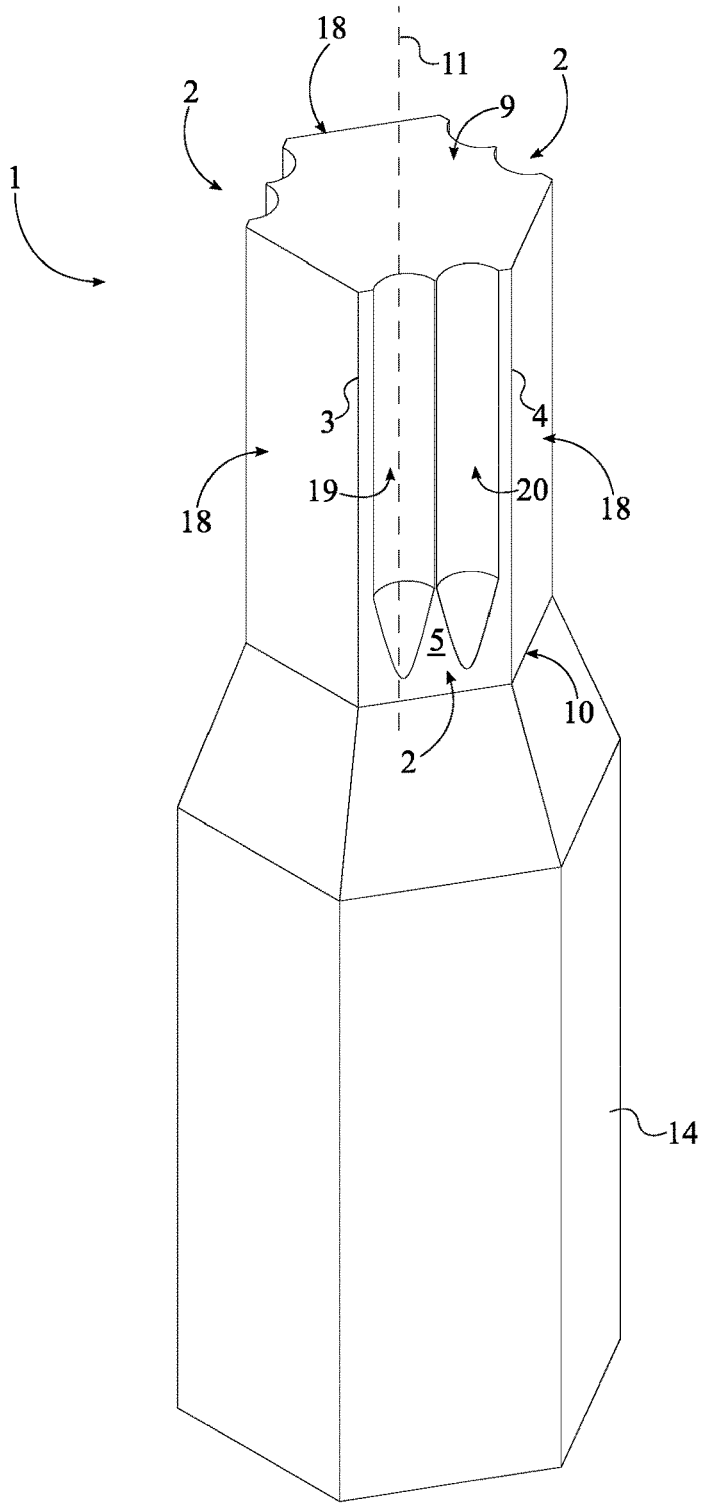
FIG. 5 is a perspective view of a further alternative embodiment of the present invention.

Referring to FIG. 5, the present invention may also further comprise a plurality of intermittent sidewalls 18. Each of the plurality of intermittent sidewalls 18 is a flat surface which engages the socket fastener like a traditional screw bit design. The plurality of intermittent sidewalls 18 is radially positioned about the rotation axis 11. Additionally, the plurality of intermittent sidewalls 18 is interspersed amongst the plurality of laterally-bracing sidewalls 2. Resultantly, the plurality of intermittent sidewalls 18 and the plurality of laterally-bracing sidewalls 2 radially alternate between each other.

The present invention also incorporates an attachment feature which allows an external torque tool to attach to the screw bit body 1 and transfer torque force onto the socket fastener through the screw bit body 1. Referring to FIG. 1, the present invention comprises an attachment body 14. The attachment body 14 is centrally positioned around and along the rotation axis 11 such that the rotation axis 11 of the attachment body 14 and the rotation axis 11 of the screw bit body 1 are coincidentally aligned. Additionally, the attachment body 14 is connected adjacent to the second base 10. The attachment body 14 preferably has a hexagonal cross-section in order to fit within a female attachment member of the external torque tool. External torque tools include, but are not limited to, electric drills, torque wrenches, pneumatic drills, socket screw drivers, and other similar torque tools.

Figure 6:
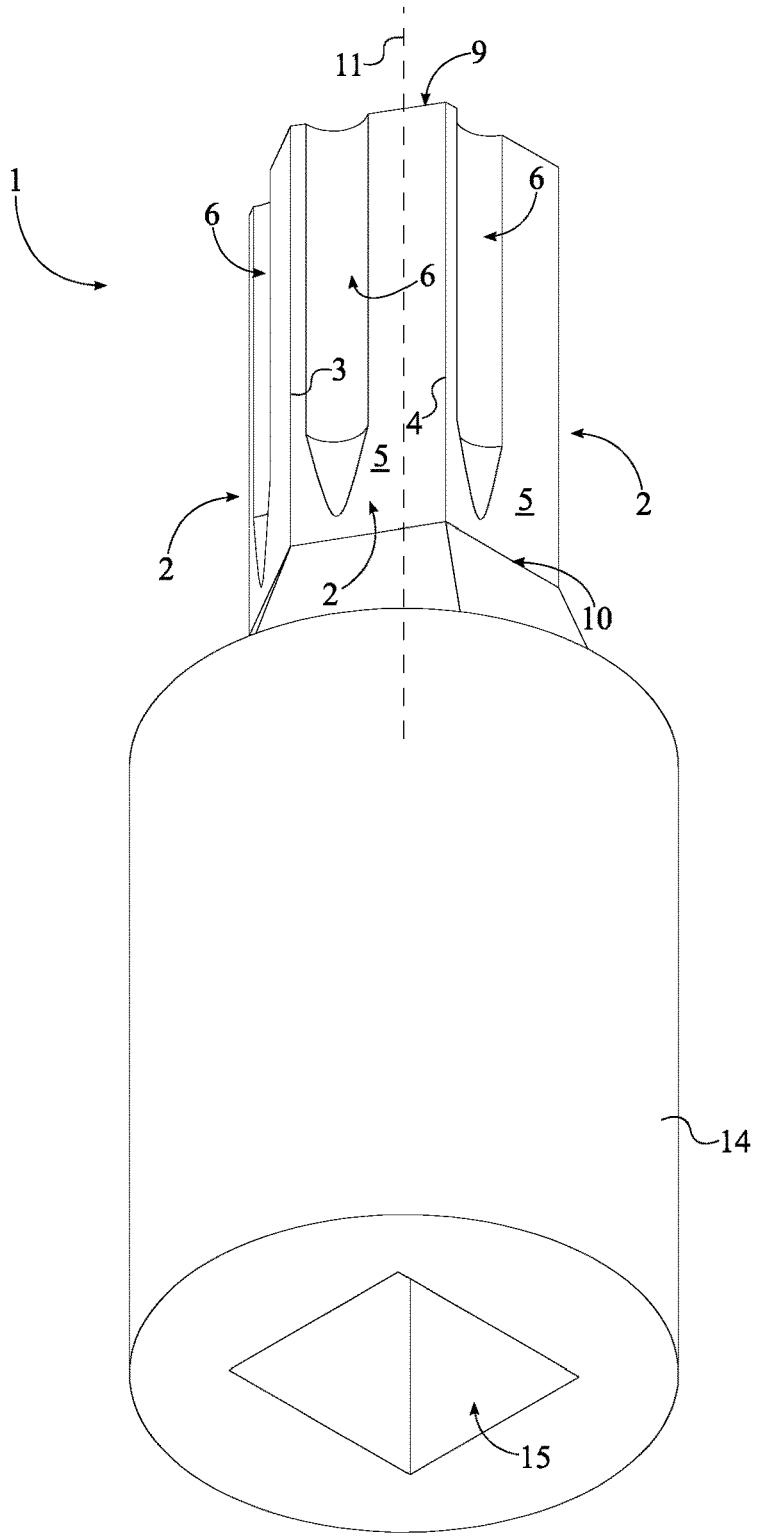
FIG. 6 is a perspective view of a further alternative embodiment of the present invention.

In another embodiment, referring to FIG. 6, the present invention further comprises an engagement bore 15. The engagement bore 15 allows the present invention to be attached to a male attachment member of an external torque tool, such as a socket wrench or a screw driver. The engagement bore 15 traverses into the attachment body 14 along the rotation axis 11, opposite the screw bit body 1. The engagement bore 15 is shaped to receive a male attachment member of a socket wrench; the preferred shape is square as the majority of socket wrenches utilize a square attachment member. In this embodiment, the preferred attachment body 14 is cylindrical shaped. In alternative embodiments, the shape and design of the engagement bore 15 and the attachment body 14 may vary to be adaptable to different torque tool designs and different attachment means.

Figure 2:
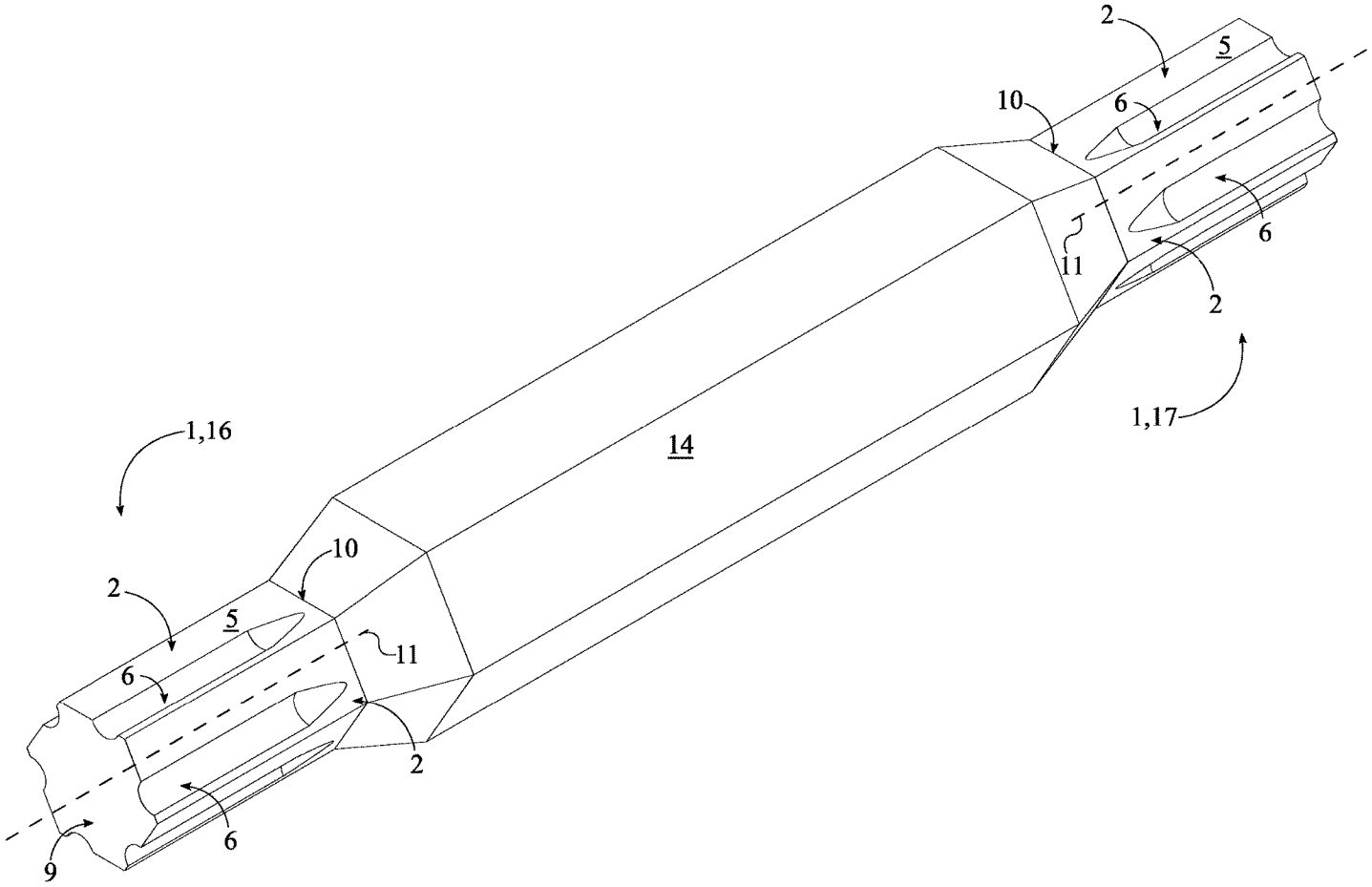
FIG. 2 is a perspective view of an alternative embodiment of the present invention.

In one embodiment, referring to FIG. 2, the present invention is implemented as a dual sided screw bit, thus providing both a clockwise and a counter-clockwise screw bit body 1 simultaneously. In this embodiment, the at least one screw bit body 1 comprises a first screw bit body 16 and a second screw bit body 17. The attachment body 14 preferably has a hexagonal cross-section. The attachment body 14 is centrally positioned around and along the rotation axis 11 of the first screw bit body 16 such that the rotation axis 11 of the attachment body 14 and the rotation axis 11 of the first screw bit body 16 are coincidentally aligned. Additionally, the attachment body 14 is connected adjacent to the second base 10 of the first screw bit body 1. The second screw bit body 17 shares the attachment body 14 with the first screw bit body 1. Thus, the second screw bit body 17 is concentrically positioned with the first screw bit body 16. Additionally, the second screw bit body 17 is positioned adjacent to the attachment body 14, opposite the first screw bit body 16, similar to traditional double-sided screw bit designs. Similar to the first screw bit body 16, the attachment body 14 is connected to the second base 10 base of the second screw bit body 17. This embodiment yields the screw bit body 1 on either side of the attachment body 14. The first screw bit body 16 is designed to screw in a socket fastener, the clockwise version.

For this, referring to FIG. 3, the second distance 13 of the first screw bit body 16 is greater than the first distance 12 of the first screw bit body 16. This positions the additional gripping point of the first screw bit body 16 adjacent to the first lateral edge 3 of the first screw bit body 16. The second screw bit body 17 is designed to unscrew/extract the socket fastener, i.e. the counter-clockwise version. Referring to FIG. 4, the first distance 12 of the second screw bit body 17 is greater than the second distance 13 of the second screw bit body 17. This positions the additional gripping point of the second screw bit body 17 adjacent to the second lateral edge 4 of the second screw bit body 17.

In another embodiment of the present invention, referring to FIG. 5 the at least one engagement cavity 6 comprises a first cavity 19 and a second cavity 20. This embodiment is a simultaneous clockwise and counter-clockwise implementation of the present invention. In particular, the first cavity 19 and the second cavity 20 are oriented parallel and offset to each other. The first cavity 19 is positioned adjacent and offset to the first lateral edge 3 and the second cavity 20 is positioned adjacent and offset to the second lateral edge 4. This allows the user to rotate the present invention either in the clockwise or counter-clockwise rotation without removing the present invention from the torque tool while still taking advantage of the additional gripping point. In this embodiment, it is preferred that the present invention further comprises the plurality of intermittent sidewalls 18, wherein the plurality of intermittent sidewalls 18 is interspersed amongst the plurality of laterally-bracing portions.

Figure 7:
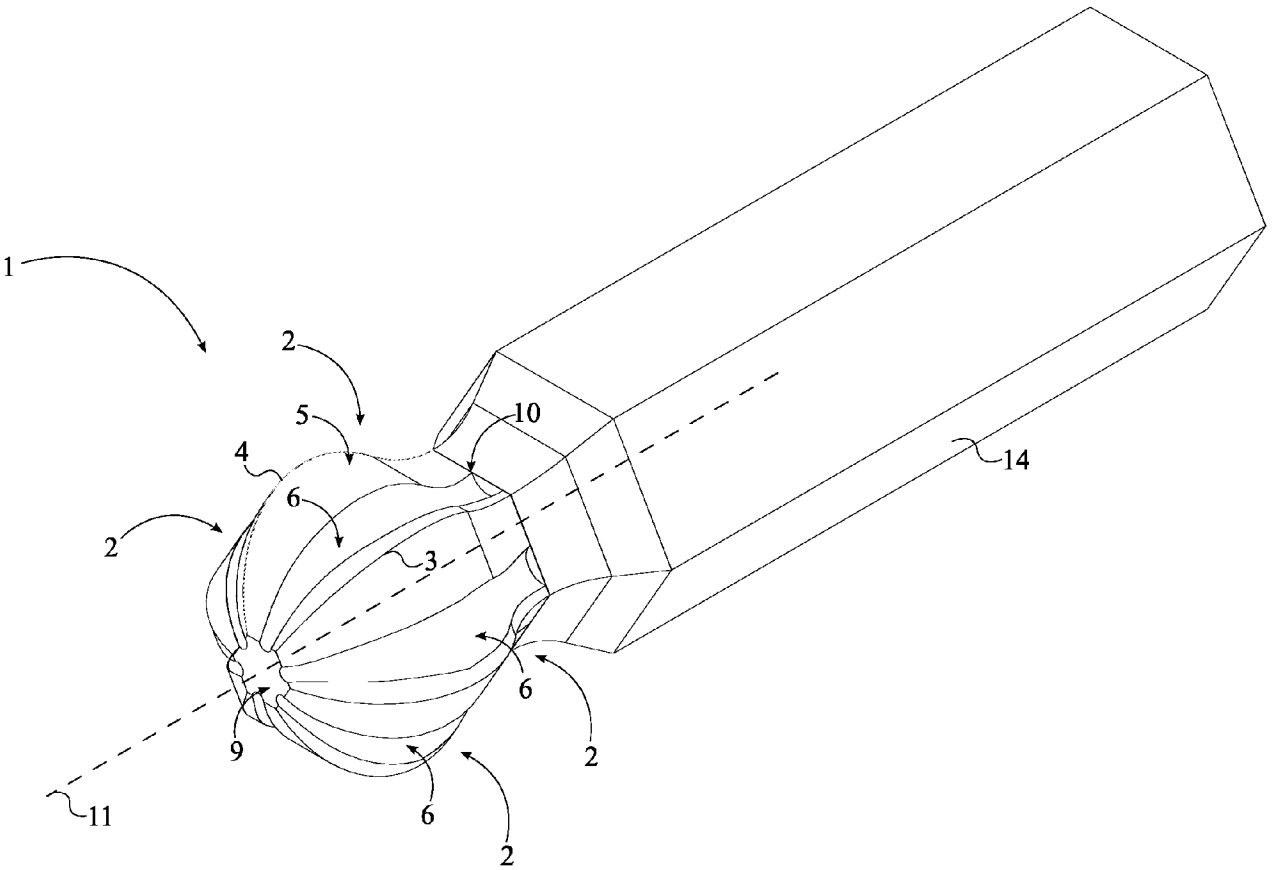
FIG. 7 is a perspective view of a further alternative embodiment of the present invention.

Referring to FIG. 7, in an alternative embodiment, the present invention is implemented as a ball end screw bit. In this embodiment, the bracing surface 5 of each of the plurality of laterally-bracing sidewalls 2 is a concave surface. As a result, the screw bit body 1 overall has a ball-like shape. This allows the user to engage the socket fastener at an angle, an especially useful feature for fasteners located in hard to reach areas.

Although the invention has been explained in relation to its preferred embodiment, it is to be understood that many other possible modifications and variations can be made without departing from the spirit and scope of the invention as hereinafter claimed.

What is claimed is:

1. A multi-grip socket bit comprising:

at least one screw bit body;

the at least one screw bit body comprising a plurality of laterally-bracing sidewalls, a first base and a second base;

each of the plurality of laterally-bracing sidewalls comprising a first lateral edge, a second lateral edge, a bracing surface and an engagement cavity;

the plurality of laterally-bracing sidewalls being radially positioned about a rotation axis of the at least one screw bit body;

the first lateral edge and the second lateral edge being positioned opposite to each other across the bracing surface;

the engagement cavity extending normal and into the bracing surface;

the engagement cavity extending into the at least one screw bit body from the first base towards the second base;

the engagement cavity being positioned offset from the first lateral edge by a first distance;

the engagement cavity being positioned offset from the second lateral edge by a second distance, wherein the first distance is greater than the second distance;

an entire cross-section of the engagement cavity being a partially-circular profile;

the entire cross-section of the engagement cavity being parallel to the first base and the second base;

the partially-circular profile being concave along a direction from the first lateral edge to the second lateral edge;

the first base comprising a first base surface;

the first base surface and the bracing surface each being flat; and the first base surface and the bracing surface being oriented perpendicular to each other.

2. The multi-grip socket bit as claimed in claim 1 comprising:

an attachment body;

an engagement bore;

the attachment body being centrally positioned around and along the rotation axis;

the attachment body being connected adjacent to the second base; and the engagement bore traversing into the attachment body along the rotation axis, opposite the at least one screw bit body.

3. The multi-grip socket bit as claimed in claim 1 comprising:

an attachment body;

the attachment body being centrally positioned around and along the rotation axis; and the attachment body being connected adjacent to the second base.

4. The multi-grip socket bit as claimed in claim 1 comprising:

an attachment body;

the at least one screw bit body comprising a first screw bit body and a second screw bit body;

the attachment body being centrally positioned around and along the rotation axis of the first screw bit body;

the attachment body being connected adjacent to the second base of the first screw bit body;

the second screw bit body being concentrically positioned with the first screw bit body;

the second screw bit body being positioned adjacent to the attachment body, opposite the first screw bit body;

the attachment body being connected adjacent to the second base of the second screw bit body;

the first distance of the first screw bit body being greater than the second distance of the first screw bit body; and the second distance of the second screw bit body being greater than the first distance of the second screw bit body.

5. The multi-grip socket bit as claimed in claim 1 comprising:

the at least one screw bit body comprising a plurality of intermittent sidewalls;

the plurality of intermittent sidewalls being radially positioned about the rotation axis; and the plurality of intermittent sidewalls being interspersed amongst the plurality of laterally-bracing sidewalls.

6. The multi-grip socket bit as claimed in claim 1 comprising:

the engagement cavity comprising a first cavity and a second cavity;

the first cavity and the second cavity being orientated parallel and offset to each other;

the first cavity being positioned adjacent to the first lateral edge; and the second cavity being positioned adjacent to the second lateral edge.

7. The multi-grip socket bit as claimed in claim 1, wherein the proportion between the first distance, the second distance, and a width of the engagement cavity is 1:5:4.

8. The multi-grip socket bit as claimed in claim 1, wherein the engagement cavity tapers from the first base to the second base.

* * * * *